United States Patent [19]

Ernst et al.

[11] Patent Number: 4,565,243

[45] Date of Patent: Jan. 21, 1986

[54] HYBRID HEAT PIPE

[75] Inventors: Donald M. Ernst, Leola; James L. Sanzi, Lancaster, both of Pa.

[73] Assignee: Thermacore, Inc., Lancaster, Pa.

[21] Appl. No.: 444,448

[22] Filed: Nov. 24, 1982

[51] Int. Cl.[4] ..... F28D 15/00

[52] U.S. Cl. ..... 165/104.26; 165/46

[58] Field of Search ..... 165/104.26, 46

[56] References Cited

U.S. PATENT DOCUMENTS

| | | | |
|---|---|---|---|
| 1,411,459 | 4/1922 | Severin | 29/421 |
| 3,566,650 | 3/1971 | Johnson | 29/421 |
| 3,604,503 | 9/1971 | Feldman, Jr. et al. | 165/46 |
| 3,604,504 | 9/1971 | Kessler et al. | 165/46 |
| 3,650,189 | 8/1972 | Noren | 165/104.26 |
| 3,681,843 | 8/1972 | Arcella | 165/104.26 |
| 3,746,081 | 7/1973 | Corman | 165/104.26 |
| 3,754,594 | 8/1973 | Ferrell | 165/104.26 |
| 3,789,920 | 2/1974 | Low | 165/104.26 |
| 3,822,743 | 7/1974 | Waters | 165/104.26 |
| 3,857,441 | 12/1974 | Arcella | 165/104.26 |
| 4,040,478 | 8/1977 | Pogson et al. | 165/104.26 |
| 4,108,239 | 8/1978 | Fries | 165/104.26 |
| 4,196,504 | 4/1980 | Eastman | 165/104.26 |

*Primary Examiner*—Albert W. Davis, Jr.
*Attorney, Agent, or Firm*—Martin Fruitman

[57] ABSTRACT

A heat pipe constructed to be bent to conform to a particular mechanical configuration after is is constructed. The wick in the evaporator region is constructed from sintered metal powder; while the wick in another region of the heat pipe is constructed with a screen wick to permit bending the pipe without destruction of the wick. Arteries wound from flexible screen material are continuous through both the sintered wick, into which they are inserted, and the screen wick, to which they are also attached.

3 Claims, 4 Drawing Figures

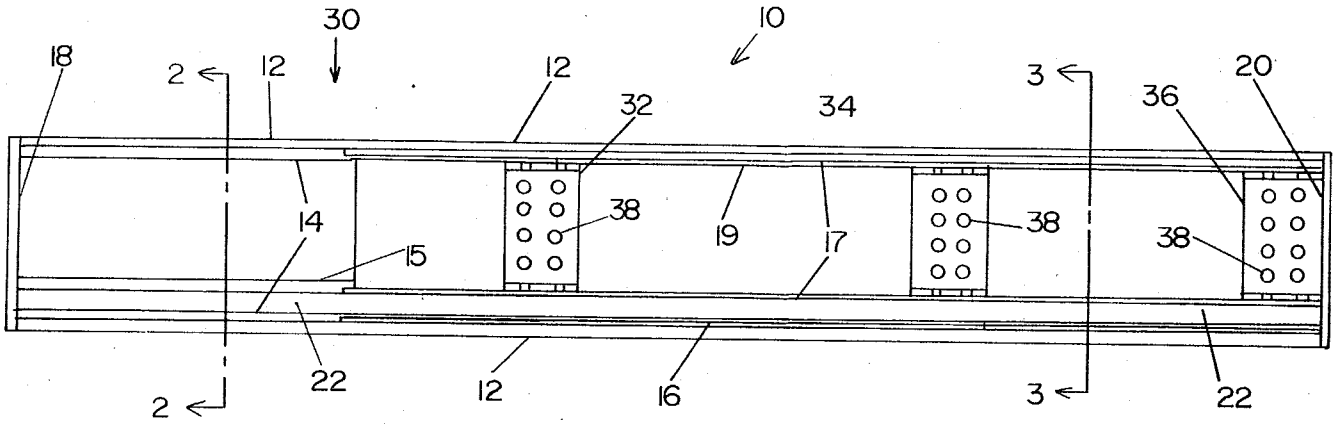
FIG. 1
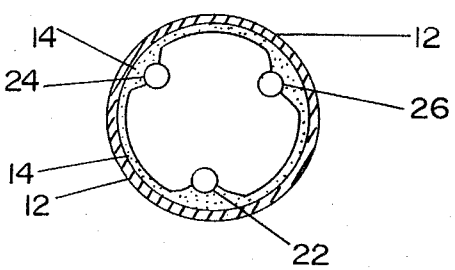
FIG. 2
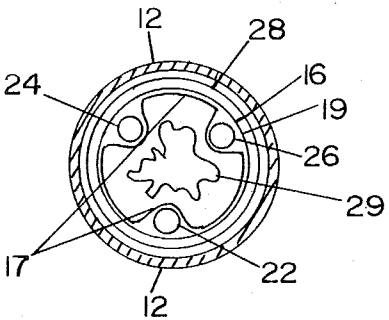
FIG. 3
FIG. 4

HYBRID HEAT PIPE

SUMMARY OF THE INVENTION

This invention deals generally with heat transfer and more specifically with a bendable heat pipe which contains a composite wick structure including sintered powder, wire mesh and longitudinal arteries.

It is well established in the heat pipe art that both capillary wicks and arteries function, under certain circumstances, to enhance the operation of heat pipes. Sintered powder wicks are particularly desireable in heat pipes in which heat transfer at high power density is required, and many heat pipes have been built with such wicks.

Sintered powder wicks may be brittle, a condition which imposes obvious mechanical limitations on their use. They may crumble if subjected to excessive mechanical distortions such as bonding.

There are, however, many applications for heat pipes in which the heat pipe can not be formed into its final configuration. When, for instance, a heat pipe is required to be placed in another pipe whose axis is bent, the heat pipe usually must be bent at a time after its original construction. While such applications do not require the complexity of a truly flexible heat pipe, that is, one which will flex even during operation, a simple sintered wick heat pipe nevertheless, may not survive the bending required.

The present invention therefore presents a bendable heat pipe capable of the high power densities associated with sintered wick heat pipes, but which can be field shaped to conform to special applications. This goal is accomplished by constructing a heat pipe with two entirely different types of wicks, suitably joined, so that the evaporator region, where the transfer of high power density is most critical, uses a sintered wick structure, but another region of the heat pipe has a wick constructed of highly flexible screen. Flexible screen arteries are mounted within the heat pipe so that they run continuously through both wick materials.

The arteries can be molded into the sintered wick during the sintering process so that the structure and operation of the arteries are without discontinuity. The arteries are connected to the screen wick by "sandwiching" them between two layers of screen wick, the outer layer of which is adjacent to the heat pipe casing. The inner layer of screen wick is constructed to conform to the combined configuration of the arteries and outer screen layer, and thereby retains the arteries in place in both the radial and axial directions of the heat pipe. Nevertheless, the use of mechanical pressure and the absence of rigid bonds between the arteries and screening permits minor slippage between them during the heat pipe bending operation and therefore prevents internal heat pipe damage.

While the simplest means to insert the arteries into the sintered wick is to do so before sintering and to mold the arteries in place, it is also possible to insert the arteries into a cylinder previously molded into the sintered wick. A satisfactory configuration can also be achieved by molding indentations into the inside surface of the sintered wick and attaching the arteries to those indentations by mechanical means.

The heat pipe casing is, of course, constructed of a solid material with ductility and thickness suitable for the degree of field reshaping required. The screen wick and screen arteries are also particularly designed to permit bending without undue distortion of their cylindrical shapes. This is accomplished by constructing the screen cylinders with both the warp and the woof of the material at angles to the axis of the cylinder. While such a configuration has previously been suggested for the wick of heat pipes in U.S. Pat. No. 3,604,504 by Kessler, et al, similar construction for the smaller diameter arteries yields arteries so flexible that they can easily be tied into a knot. This superior flexibility assures that the arteries will not be damaged during the field shaping operation.

BRIEF DESCRIPTION OF DRAWINGS

FIG. 1 is a cross sectional view along the length of the heat pipe of the preferred embodiment of the invention.

FIG. 2 is a cross section view of the preferred embodiment of the invention, transverse to the axis of the heat pipe at section 2—2 of FIG. 1 in the evaporator region.

FIG. 3 is a cross section view of the preferred embodiment of the invention, transverse to the axis of the heat pipe at section 3—3 of FIG. 1 in a region other than the evaporator region.

FIG. 4 is a cross section view of an alternate embodiment for the evaporator region of the heat pipe.

DETAILED DESCRIPTION OF THE INVENTION

The preferred embodiment of hybrid heat pipe 10 is shown in FIG. 1 in a cross section view with the plane of cross section passing through the axis of heat pipe 10. Heat pipe 10 is shown in FIG. 1 prior to bending to conform to its final shape in a field location.

Casing 12 of heat pipe 10 is constructed from a material sufficiently thin and ductile to permit later bending of heat pipe 10 at least once without rupture of casing 12. Wick sections 14 and 16 are each constructed of different materials to attain different characteristics.

As better shown in FIG. 2, a cross section of heat pipe 10 taken in plane 2—2 of FIG. 1, wick 14, located in the active evaporator region of heat pipe 10, is made from sintered powder material, formed in place in intimate contact with the inner surface of casing 12. This fine grained sintered wick provides the ability for heat pipe 10 to transfer heat at high power density in the critical evaporator region.

Located within sintered powder wick 14 are several arteries 22, 24 and 26. The arteries are covered by layer 15 of sintered powder wick 14. They may be molded into sintered wick 14 or inserted after molding of the wick. Arteries 22, 24 and 26 are themselves made from screen material and are constructed in a particular manner to enhance their flexibility.

This construction technique involves orienting all the wires of the screen, both the warp and woof of the material, at an angle to the axis of the cylinder into which the screen is formed. This can be accomplished in three ways. In one method the original wire cloth material is simply wrapped on a mandrel in a spiral form. For another method the wire cloth is wrapped in the more conventional form with one set of wires parallel to the mandrel axis and, after completion, the cylinder is twisted by holding one end and turning the other end. The third method involves cutting conventional screen cloth at an angle to form edges at angles to the wires and then wrapping the newly formed edges into a conventional cylinder.

These same techniques are used to construct screen wick 16 which is mounted through the non-evaporator regions of the heat pipe to yield a screen which will not be damaged by later bending.

As shown in FIG. 3 screen wick 16 is actually assembled from two independent screen cylinders 17 and 19, and for more satisfactory operation a third screen cylinder 28 can first be sintered to the inside surface of casing 12. Screen cylinders 17 and 19 are used to hold arteries 22, 24 and 26 in place during insertion into heat pipe casing 12, and the junction of arteries 22, 24 and 26 and of screens 17 and 19 with sintered wick 14 can be formed during the process of sintering wick 14 by molding the screen components into the sintered wick. Screens 19 and 17 need not be molded into sintered wick 14, however, as long as they abut at plane 30.

Screen 17 is conformed to arteries 22, 24 and 26 and to outerscreen 19 by inflating bladder 29 with fluid inside the casing and forcing screen 17 radially outward. Once formed bladder 29 is removed, and the screens and arteries are held in place during operation by the outward pressure of spring clips 32, 34, and 36 which contain holes 38 to permit transport of liquid and vapor through the clips. When evacuated and loaded with an appropriate heat transfer fluid, complete heat pipe 10 therefore results in a device with high power density capabilities, but, unlike pipes constructed with the entire wick of sintered material, it can be bent to conform with the apparatus to which it is attached without destroying the wick structure.

FIG. 4 shows an alternate embodiment for the evaporator region of the heat pipe axis. In this variation of construction, sintered wick 14 does not completely enclose arteries 22, 24 and 26, but is instead formed with indentations to aid in later location of the arteries. In such construction arteries 22, 24 and 26 are held in place by mechanical means such as, for instance, clips similar to clips 34 in FIG. 1.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the hybrid wick structure could be constructed without arteries within it. Also, the heat pipe can be shaped prior to evacuation, filling with liquid and processing, rather than after completion of all processing, if such action is advantageous in the particular application.

What is claimed as new and desired to be secured by Letters Patent of the United States is:

1. A heat pipe comprising:

a completely enclosed casing of sufficiently thin and ductile material to permit bending of the casing at least once without rupture of the casing;

a first wick structure located within the active evaporator region of the heat pipe, made from sintered powder material and located in intimate contact with the inside surface of the casing;

a second wick structure, located within a region of the heat pipe other than the evaporator region, made from flexible screen material and located in intimate contact with the inside surface of the heat pipe, one end of which abuts the sintered material of the first wick structure at the point where the first and second wicks meet, wherein the second wick is comprised of at least two separate screen layers, the outer layer being sintered to the inside surface of the casing and the next layer being located in intimate contact with the outer layer; and an appropriate heat transfer fluid.

2. The heat pipe of claim 1 further comprising at least one flexible screen artery captured between the two separate screen layers.

3. The heat pipe of claim 1 further comprising at least one spring clip located against the inner surface of the innermost screen and providing outward pressure to hold the entire wick against the heat pipe casing.

* * * * *